US005175490A

United States Patent [19]

Steinbach

[11] Patent Number: 5,175,490

[45] Date of Patent: Dec. 29, 1992

[54] REFERENCE VOLTAGE SOURCE

[75] Inventor: Gunter Steinbach, San Jose, Calif.

[73] Assignee: Hewlett Packard Company, Palo Alto, Calif.

[21] Appl. No.: 863,642

[22] Filed: Apr. 3, 1992

[51] Int. Cl.[5] ..... G05F 3/08

[52] U.S. Cl. ..... 323/354; 323/352

[58] Field of Search ..... 323/367, 313, 352, 353, 323/354

[56] References Cited

U.S. PATENT DOCUMENTS

| | | | |
|---|---|---|---|
| 4,364,006 | 12/1982 | Makaba et al. | 323/354 |
| 4,641,081 | 2/1987 | Sato et al. | 323/313 |
| 4,663,584 | 5/1987 | Okada et al. | 323/313 |
| 4,804,941 | 2/1989 | Yoshii | 341/140 |
| 4,833,342 | 5/1989 | Kiryu et al. | 307/296.1 |

OTHER PUBLICATIONS

T. Takemoto et al., "A Fully Parallel 10-Bit A/D Converter with Video Speed".

*Primary Examiner*—Steven L. Stephan
*Assistant Examiner*—Adolf Berhane
*Attorney, Agent, or Firm*—Peter P. Tong

[57] ABSTRACT

A reference voltage source which provides a plurality of reference voltages with equal step size between voltages despite loads connected to the reference voltage source. The reference voltage source is composed of a plurality of slave resistors connected in series to produce a plurality of output nodes and a plurality of master resistors connected in series to produce a plurality of compensation nodes. Each compensation node corresponds with one of the output nodes. A compensation resistor connects between a compensation node and the corresponding output node. A current flows through the slave resistors to generate a reference voltage at each output node. Another current flows through the master resistors and generates at each compensation node a compensation voltage that differs from the reference voltage at the corresponding output node by a magnitude sufficient to cause a compensation current to flow through the associated compensation resistor into the corresponding output node and offset a load current drawn from the output node by a load connected to the output node.

13 Claims, 7 Drawing Sheets

REFERENCE VOLTAGE SOURCE

BACKGROUND OF THE INVENTION

The present invention relates generally to a reference voltage source and more particularly to a reference voltage source that provides a plurality of reference voltages with equal step size between voltages despite loads connected to the reference voltage source.

A plurality of reference voltages with equal step size between voltages are often used in analog-to-digital converters (ADC) where an input voltage is compared to the reference voltages through comparators. Typically generated by passing a current $I_r$ through many serially connected resistors $R_r$, as shown in FIG. 1, these reference voltages are produced at nodes or junctions between the resistors. Unfortunately, with comparators or other loads connected to the nodes, load currents $I_L$ are drawn from the nodes and these load currents in turn change the values of the reference voltages at the nodes.

One method of preventing variations in the reference voltages due to load currents is to connect an extra voltage source $V_o$ to one of the nodes, as shown in FIG. 2. However, in a typical monolithic analog-to-digital converter, a reference source that provides 64 or more different reference voltages would require many extra voltage sources to hold all the reference voltages constant. This would undesirably increase the power consumption and the cost and complexity of the circuit.

FIG. 3 shows a method of providing constant reference voltages by means of unequal resistor values. The value of each resistor is determined according to the amount of load current which the circuit designer expects to be drawn through that resistor. As a first order approximation, the value of a given resistor is equal to $$R_r*(1-n*(I_L/I_r))$$

where n represents the location of the resistor with respect to the current source. This method fails if the load current $I_L$ is different from the expected value, for example due to fluctuations in the manufacturing process, or if the load current changes with time, for example due to temperature variations. Another drawback of this method is that resistors, with values different from each other, having the required precision are much more difficult to implement, especially in integrated circuit technologies, than resistors with values equal to each other.

To reduce the reference voltage error due to the load currents, FIG. 4 shows another method which feeds in compensation currents, as described in U.S. Pat. No. 4,804,941, issued to Yoji Yoshii on Feb. 14, 1989. This method simulates and offsets the load currents $I_L$ by a complex active compensation circuit CC that is made of three current mirrors, each current mirror replicating the input currents of 64 comparators. This approach is complex and difficult to implement economically.

Various devices using the above methods have been known for a number of years, and by way of examples, forms of such devices can be found in *IEEE Journal of Solid-State Circuits,* Vol SC-17, No. 6, Dec. 1982, page 1133 to 1138.

It is apparent from the foregoing that there is still a need for an efficient reference voltage source that can provide a plurality of reference voltages with equal step size between voltages despite loads connected to the reference voltage source and that can be effectively and economically implemented with various fabrication technologies.

SUMMARY OF THE INVENTION

The present invention provides a voltage source that generates a plurality of equally-spaced reference voltages despite the impact of load currents. This voltage source can be implemented economically and efficiently in monolithic integrated circuits and by means of other circuit technologies.

Briefly and in general terms, a reference voltage source according to the invention includes a plurality of slave resistors connected in series to form a slave stick with a plurality of output nodes. A plurality of master resistors are similarly connected in series to form a master stick with a plurality of compensation nodes. Each compensation node corresponds with one of the output nodes. A compensation resistor is associated with each compensation node, and each such resistor is connected between its associated compensation node and the corresponding output node. A slave current flows through the slave resistors and generates a reference voltage at each output node. Similarly, a master current flows through the master resistors and generates at each compensation node a compensation voltage that differs from the reference voltage at the corresponding output node by a magnitude sufficient to cause a compensation current to flow through the associated compensation resistor into the corresponding output node and offset a load current drawn by a load connected to the output node.

In one preferred embodiment of the invention, the voltage across all the slave resistors on the slave stick is equal to the voltage across all the master resistors on the master stick and the number of output nodes is equal to the number of compensation nodes.

A bias voltage source is connected between the first compensation node on one end of the master stick and ground, while the output node corresponding to the first compensation node is connected to ground.

Each of the compensation resistors is approximately the same in physical construction and in value as each of the other compensation resistors. Each of the slave resistors is approximately the same in physical construction and in value as each of the other slave resistors, and similarly, each of the master resistors is approximately the same in physical construction and in value as each of the other master resistors.

The bias voltage source can be made of an operational amplifier with a reference current source. The reference current source supplies a current which is approximately equal in magnitude and direction to the load current. The operational amplifier has an inverting input connected to the reference current source, a non-inverting input connected to ground and an output connected to the first compensation node. The bias voltage source also includes a resistor, approximately the same in physical construction and in value as the compensation resistor, connected between the inverting input and the output of the operational amplifier.

The range of the reference voltages on the output nodes can be translated by not grounding the output node corresponding to the first compensation node but having an end voltage source connected between it and ground. In this embodiment, the bias voltage source is connected between the first compensation node and the corresponding output node rather than between the compensation node and ground.

A second preferred embodiment of the present invention has compensation resistors at selected output nodes rather than at all the output nodes. The voltage across the master stick is approximately equal to the voltage across the slave stick and the sum of the currents flowing through the compensation resistors is approximately equal to the sum of the load currents from the output nodes.

A third preferred embodiment of the present invention has an equal number of master and slave resistors. A master current source connected to the last compensation node causes the master current to flow from the first compensation node to the last compensation node. The values of the master resistors decrement from a normal master resistor value, starting from the master resistor connected to the last compensation node to the master resistor connected to the first compensation node, by a constant step size so that the voltage across each pair of adjacent compensation nodes is approximately the same as each of the other pair of adjacent compensation nodes.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

As shown in the exemplary drawings, a reference voltage source according to the invention generates a plurality of equally-spaced reference voltages despite the impact of load currents drawn by loads connected to various output nodes of the voltage source. Various techniques such as strings of resistors of differing values and complicated active circuits have been proposed to generate reference voltages, but these have been inefficient and have been difficult to implement in technologies such as monolithic circuitry.

A reference voltage source according to the invention provides a large number of equally-spaced reference voltages, for example for use by an analog-to-digital converter. The circuitry is simple and easily fabricated with high precision in various circuit technologies. An additional advantage is that temperature compensation is easily achieved.

Figure 5:
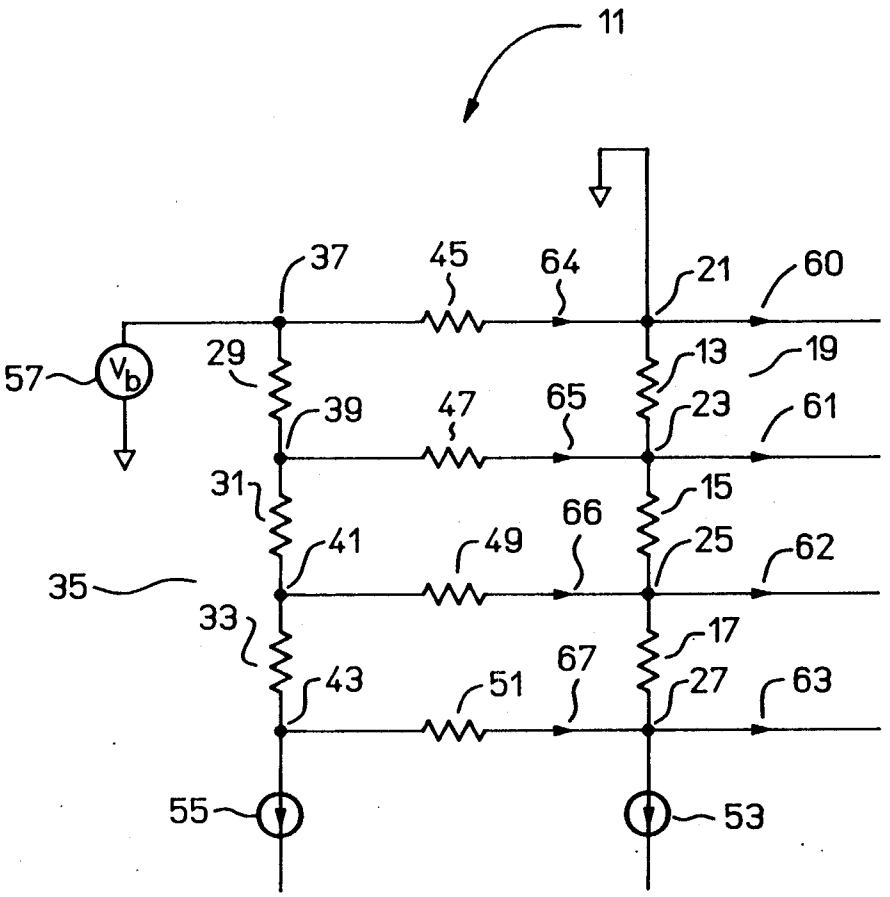
FIG. 5 shows a first preferred embodiment of the reference voltage generator according to the invention.

In accordance with the invention, a reference voltage source, generally embodying the principles of the invention, is shown in FIG. 5. A plurality of slave resistors 13, 15 and 17 are connected in series to form a slave stick, generally 19, having a plurality of output nodes 21, 23, 25 and 27. More specifically, a connection between a first terminal of the resistor 13 and ground defines an output node 21, a connection between a second terminal of the resistor 13 and a first terminal of the resistor 15 defines another output node 23, and so on.

A plurality of master resistors 29, 31 and 33 are connected in series to form a master stick 35 having a plurality of compensation nodes 37, 39, 41 and 43, each compensation node corresponding with one of the output nodes. For example, the compensation node 39 is defined by a connection between a terminal of the master resistor 29 and a terminal of the master resistor 31 and corresponds with the output node 23. The master stick 35 has two ends, the first end being the first compensation node 37 and the second end being the last compensation node 43.

A plurality of compensation resistors 45, 47, 49 and 51, one such resistor associated with each compensation node, are connected between the associated compensation nodes and the corresponding output nodes. Specifically, the compensation resistor 45 is associated with the compensation node 37 and is connected between said compensation node 37 and the corresponding output node 21, and so on.

A device to generate a current such as a slave current source 53 is connected at one end of the slave stick 19 to cause a slave current to flow through the slave resistors 13, 15 and 17 and generate a reference voltage at each output node 21, 23, 25 and 27. Similarly, a device to generate a current such as a master current source 55 is connected at the compensation node 43 of the master stick to cause a master current to flow through the master resistors 29, 31, 33 and generate at each compensation node 37, 39, 41 and 43 a compensation voltage that differs from the reference voltage at the corresponding output node 21, 23, 25 and 27. These voltages differ by magnitudes sufficient to cause compensation currents 64, 65, 66 and 67 to flow through the associated compensation resistors 45, 47, 49 and 51 into the corresponding output nodes 21, 23, 25 and 27 and offset load currents 60, 61, 62 and 63 drawn by loads connected to the output nodes. Thus, for example, the compensation voltage at the compensation node 41 differs from the output voltage at the associated output node 25 sufficiently to cause a compensation current 66 to flow through the compensation resistor 49 and to flow into the output node 25 to offset a load current 62 drawn by a load connected to the output node 25.

In the embodiment illustrated in FIG. 5, the voltage across all the master resistors 29, 31 and 33 on the master stick 35 is equal to the voltage across all the slave resistors 13, 15 and 17 on the slave stick 19 and the number of output nodes 21, 23, 25 and 27 is equal to the number of compensation nodes 37, 39, 41 and 43.

A bias voltage source 57 establishes a range of reference voltages. The bias voltage source 57 is connected between ground and the first compensation node 37 which is located at one end of the master stick 35. The output node 21, which corresponds to the first compensation node 37, is also connected to ground.

Each of the slave resistors 13, 15 and 17 is preferably approximately the same in physical construction and in value as each of the other slave resistors. Similarly, each of the master resistors 29, 31 and 33 is approximately the same in physical construction and in value as each of the other master resistors. Each of the compensation resistors 45, 47, 49 and 51 is also chosen to be approximately the same in physical construction and in value as each of the other compensation resistors. As an example, the compensation resistor is 4000 ohms; the master resistor is 160 ohms; the slave resistor is 64 ohms; the bias voltage source is 1.1 volts; the master current is 2 ma; the slave current is 5 ma and the compensation current is 0.025 ma to offset each of the load currents 60, 61, 62 and 63 which is approximately equal in value to each of the other load currents.

An important feature of this invention is the low sensitivity of the compensation current to variation in the voltages on the master stick 35. The voltages across all the compensating resistors are approximately the same. If the voltage across one of the compensation resistor 49 is $V_c$ and the voltage at its corresponding master node 41 changes by $\Delta V_m$, the relative change in the compensation current $I_c$ flowing out of the master node 41 is $$\frac{\Delta I_c}{I_c} = \frac{\Delta V_m}{V_c}$$

With $I_c$ fixed by the load current $I_L$, by making the compensating voltage $V_c$ large through making the compensating resistor $R_c$ large, the preferred embodiment will have a low compensation current sensitivity. Therefore, each of the compensation currents 64, 65, 66 and 67 will be almost identical to each of the other compensation currents.

Figure 6:
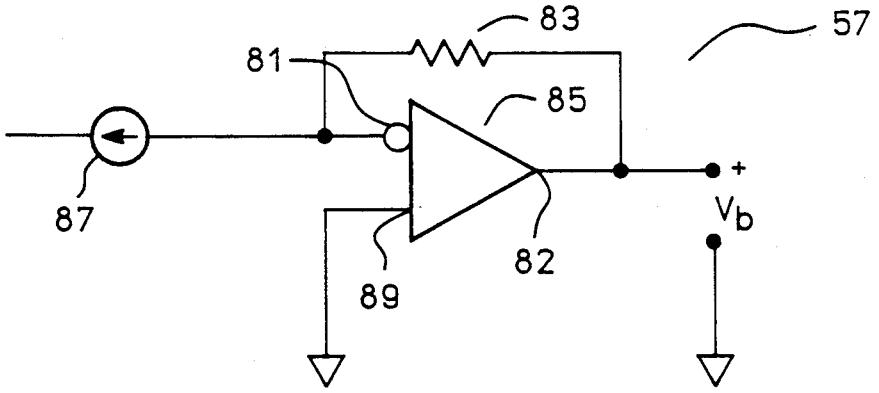
FIG. 6 shows an embodiment of the bias voltage source connected to the master stick in FIG. 5.

FIG. 6 shows an embodiment of the bias voltage source 57 which is shown connected to the master stick in FIG. 5. This embodiment compensates for the variations in the load currents and the compensation resistors due to factors such as temperature change or fluctuation in the manufacturing process. The bias voltage source 57 can be made of an operational amplifier 85 with a reference current source 87. The reference current source 87 supplies a current which is approximately equal in magnitude and direction to the load current $I_L$. The operational amplifier 85 has an inverting input 81 connected to the reference current source 87, a noninverting input 89 connected to ground and an output 82 connected to the first compensation node 37 in FIG. 5. The bias voltage source 57 also includes a resistor 83, approximately the same in physical construction and in value as the compensation resistor, connected between the inverting input 81 and the output 82 of the operational amplifier 85.

With the bias voltage as $V_b$, the compensation resistor replica 83 as $R_c'$, the compensation resistor as $R_c$ and the current provided by the reference current source 87 as $I_L'$, the output 82 of the operational amplifier 85 becomes $$V_b = I_L' * R_c'.$$

The compensation current $I_c$ is equal to $$I_c = \frac{V_b}{R_c} = \frac{I_L' * R_c'}{R_c} \cong I_L' \cong I_L$$

and will track variations in both the compensation resistor $R_c$ and the load current $I_L$. This correction relies on the tracking of $I_L'$ with $I_L$, and $R_c'$ with $R_c$, a tracking which is ensured to a large degree by incorporating on a monolithic integrated circuit all the elements making up the described reference voltage source.

Figure 7:
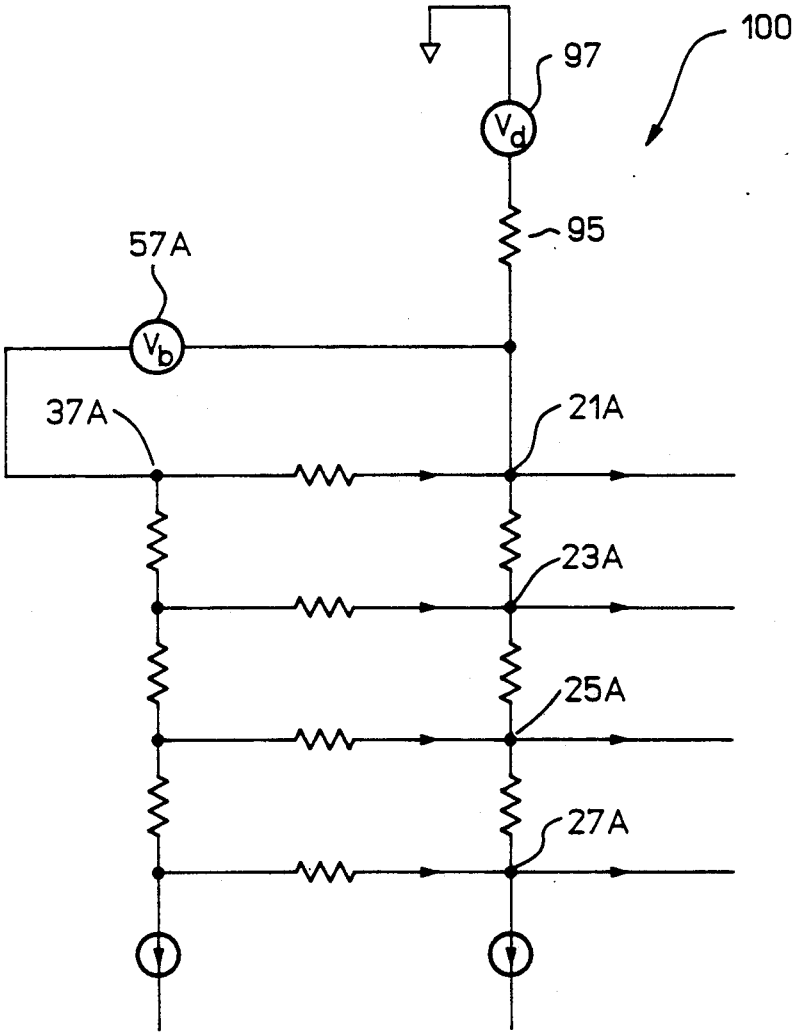
FIG. 7 shows an alternate embodiment similar to FIG. 5 which includes a voltage source at the top of the slave stick.

FIG. 7 shows an embodiment of the invention similar to that shown in FIG. 5 and for convenience, components in FIG. 7 that are similar to components in FIG. 5 are assigned the same reference numerals accompanied by the letter "A", and additional components are assigned different reference numerals.

In FIG. 7, the range of the voltages on the output nodes 21A, 23A, 25A and 27A can be translated by having an end resistor 95 connected to the output node 21A corresponding to the first compensation node 37A and an end voltage source 97 connected between the end resistor 95 and ground. It is not necessary to have the end resistor 95 but changing the end resistor 95 serves as another method to translate the range of the voltages on the output nodes 21A, 23A, 25A and 27A. The bias voltage source 57A, rather than connecting between the first compensation node 37A and ground, is connected between the first compensation node 37A and the corresponding output node 21A to ensure that the voltages on the compensation resistors remain similar to the voltages on the compensation resistors in FIG. 5. The bias voltage source 57A can again be implemented as an operational amplifier as described above but with its noninverting input connected to the output node 21A corresponding to the first compensation node 37A. As an example, the end resistor 95 is 64 ohms and the end voltage source 97 is 1.31 volts.

Figure 8:
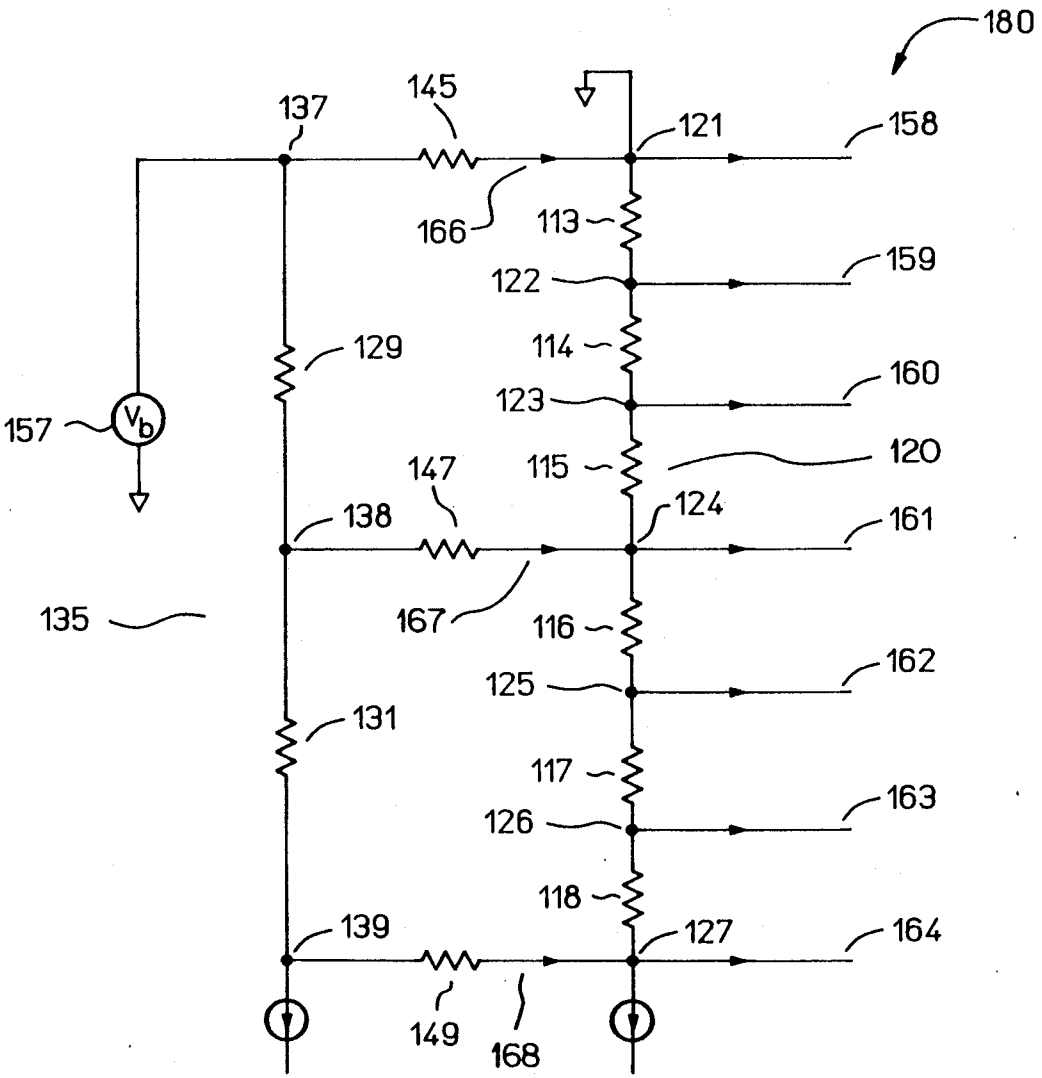
FIG. 8 shows a second preferred embodiment of the reference voltage generator according to the invention.

FIG. 8 shows a second preferred embodiment 180 of a reference voltage generator according to the invention. In this embodiment, compensation resistors are used only at selected output nodes.

In the second embodiment 180, all the master resistors 129, 131, with each approximately the same in physical construction and in value as each of the other master resistors, are connected in series to form a master stick 135 having a plurality of compensation nodes 137, 138 and 139. For example, the compensation node 138 is defined by a connection between a terminal of the master resistor 129 and a terminal of the master resistor 131. The master stick 135 has two ends, the first end being the first compensation node 137 and the second end being the last compensation node 139. In between the first compensation node and the last compensation node, there is an intermediate compensation node 138.

All the slave resistors 113 to 118, with each approximately the same in physical construction and in value as each of the other slave resistors, are connected in series to form a slave stick 120, having a first primary output node 121 corresponding with the first compensation node 137, a last primary output node 127 corresponding with the last compensation node 139, and an intermediate primary output node 124 between the first and the last primary output nodes, corresponding with the intermediate compensation node 138. In between each adjacent pair of primary output nodes, there are two secondary output nodes. More specifically, a connection between a first terminal of the resistor 113 and ground defines a primary node 121, a connection between a second terminal of the resistor 113 and a first terminal of the resistor 114 defines a secondary output node 122, and so on. Each primary output node corresponds with one of the compensation nodes. For example, the middle primary output node 124 corresponds to the intermediate compensation node 138.

Each of the compensation resistors 145, 147 and 149, approximately the same in physical construction and in value as each of the other compensation resistors, is associated with each compensation node and is connected between the associated compensation nodes and the corresponding primary output nodes. Specifically, the compensation resistor 147 is associated with the compensation node 138 and is connected between the compensation node 138 and the corresponding output node 124, and so on.

The voltage across the master stick 135 is approximately equal to the voltage across the slave stick 120 and the sum of the currents flowing through all the compensation resistors is approximately equal to the sum of the load currents drawn from all the primary and the secondary output nodes. This embodiment will inevitably result in errors, namely overcompensation of nodes closest to the compensation resistors and undercompensation of nodes furthest away. The sparsity of compensation resistors is limited by how much compensation error can be tolerated in a particular application.

The current 166 flowing into the first primary output node 121 through the compensation resistor 145 is approximately equal to the load current 158 drawn from the first primary output node 121 plus one-half the sum of the load currents drawn from all the secondary output nodes 122, 123 between the first primary output node 121 and the adjacent primary output node 124. For the circuit shown in FIG. 8, the current 166 flowing through the first compensation resistor 145 has the magnitude of two load currents.

The current 168 flowing into the last primary output node 127 through the compensation resistor 149 is approximately equal to the load current 164 drawn from the last primary output node 127 plus one-half the sum of the load currents 162, 163 drawn from all the secondary output nodes 125, 126 between the last primary output node 127 and the adjacent primary output node 124. For the circuit shown in FIG. 8, the current 168 flowing through the last compensation resistor 149 has the magnitude of two load currents.

The current 167 flowing into the intermediate primary output node 124 through the compensation resistor 147 is approximately equal to the load current 161 drawn from the intermediate primary output node 124 plus the sum of the load currents drawn from all the secondary output nodes between the intermediate primary output node 124 and the adjacent primary output node on either side of the intermediate primary output node 124. For the circuit shown in FIG. 8, the current 167 flowing through the intermediate compensation resistor 147 has the magnitude of three load currents.

Figure 1:
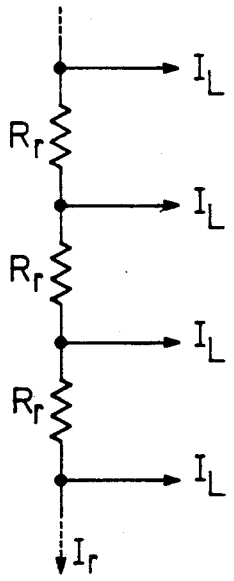
FIG 1 (PRIOR ART)
FIG. 1 shows a prior art reference voltage source with serially connected reference resistors.
Figure 2:
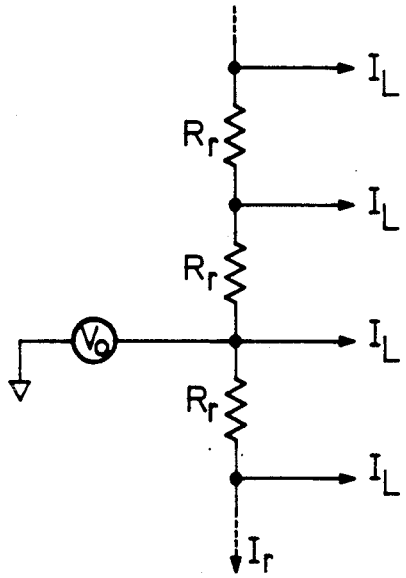
FIG 2 (PRIOR ART)
FIG. 2 shows a prior art reference voltage source with an additional voltage source.
Figure 3:
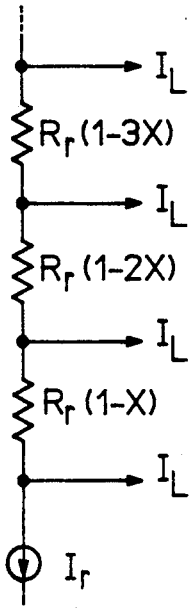
FIG 3 (PRIOR ART)
FIG. 3 shows a prior art reference voltage source with resistors of different values.
Figure 4:
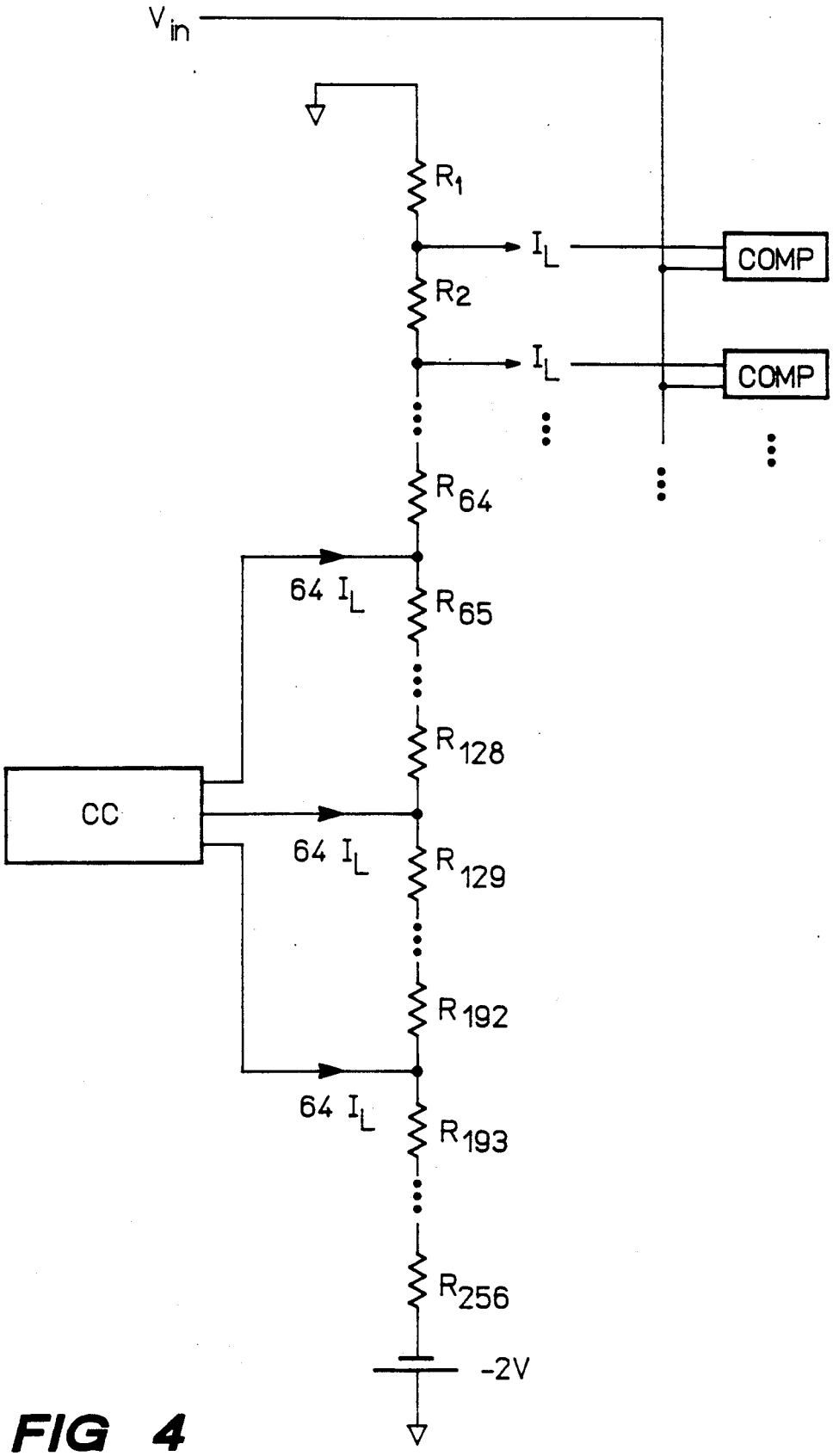
FIG 4 (PRIOR ART)
FIG. 4 shows a prior art reference voltage source with compensating currents generated by a complex active compensation circuit.
Figure 9:
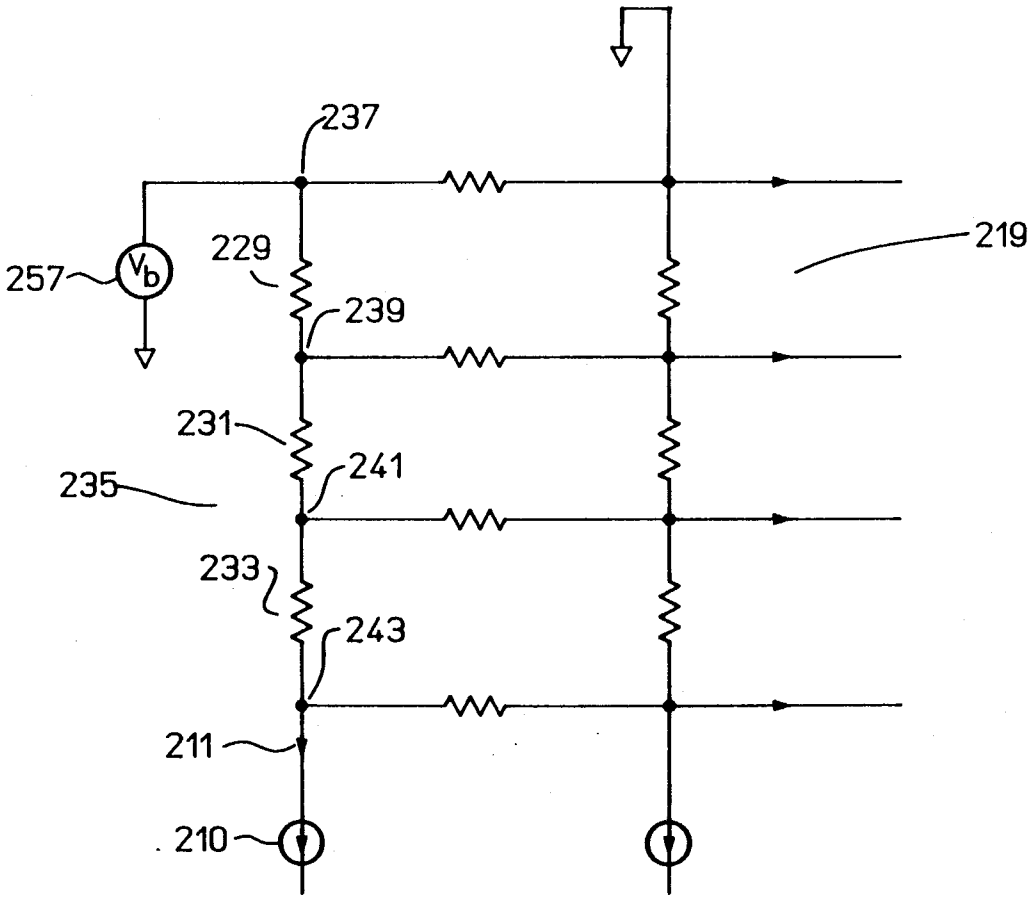
FIG. 9 shows a third preferred embodiment of the reference voltage generator according to the invention.

FIG. 9 shows a third preferred embodiment of the present invention. This embodiment is similar to the embodiment shown in FIG. 5 except, in order to offset the compensation currents drawn from the master stick 235, the values of the master resistors 229, 231 and 233 are tapered. The improvement of this topology to the prior art shown in FIG. 3 is that the prior art reference stick supplies reference voltages only for one specific load current. If the load current becomes different from the specific load current, the reference voltages will be undesirable levels. However, in the present embodiment, the master stick 235 does not supply the reference voltages, but supplies the compensation currents for the slave stick 219 which supplies the reference voltages. If the load current becomes different from the specific load current, a different bias voltage 257 can be used to offset the difference.

Furthermore, the tolerance of the tapering master resistors can be less than the prior art tapering resistors while still maintain the same accuracy for the reference voltages. This is again because the prior art tapering stick supplies reference voltages. If their resistors are different from the nominal values, the reference voltages directly track the difference. This is a first order error. However, in the present case, the master stick 235 supplies compensation currents. So if the values of the master resistors are different from the nominal values, the compensation currents which are used to correct for errors in the reference voltages will be different. This is a second order error. Therefore, the tolerance of the tapering master resistors does not have to be as well controlled as the prior art tapering resistors but still achieves the same accuracy for the reference voltages.

In this embodiment, the number of master resistors is equal to the number of slave resistors. A master current source 210 connected to the last compensation node 243 causes a master current 211 to flow from the first compensation node 237 to the last compensation node 243.

The values of the master resistors 229, 231 and 233 decrement from a nominal master resistor value, starting from the master resistor 233 connected to the last compensation node 243 to the master resistor 229 connected to the first compensation node 237, by a constant step size so that the voltage across each pair of adjacent compensation nodes is approximately the same as the voltage across each of the other pairs of adjacent compensation nodes. For example, the voltage across the first compensation node 237 and its adjacent compensation node 239 is approximately equal to the voltage across the last compensation node 243 and its adjacent compensation node 241. The constant step size $$X = \frac{R_M * I_C}{I_M}$$

$R_M$=the nominal master resistant value,
$I_c$=the compensation current,
$I_M$=the master current.

As an example, with $R_M$ was 160 ohms, $I_c$ as 0.025 ma and $I_m$ as 2 ma, the step size is 2 ohms. Thus, the values for the master resistors 233, 231 and 229 are 158 ohms, 156 ohms, 156 ohms and 154 ohms respectively.

The decrement becomes increment if the master current flows from the last compensation node to the first compensation node or if the compensation current flows from the output node to its corresponding compensation node.

Figure 10:
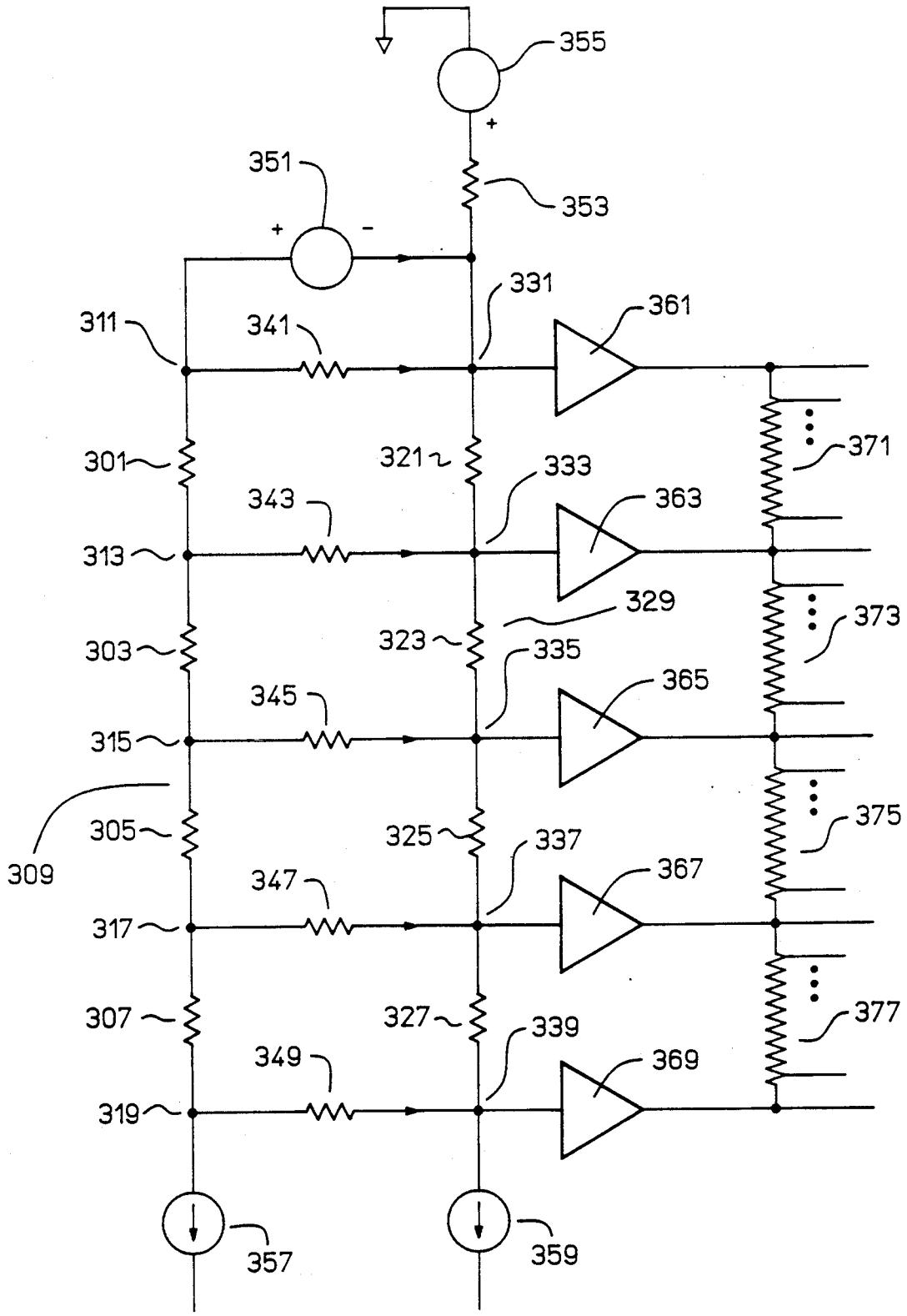
FIG. 10 shows an example of a working embodiment according to the invention.

FIG. 10 shows an example of a working embodiment of a voltage reference source according to the invention. A plurality of master resistors 301, 303, 305 and 307 are connected in series to form a master stick 309 having a plurality of compensation nodes 311, 313, 315, 317 and 319. Similarly, a plurality of slave resistors 321, 323, 325 and 327 are connected in series to form a slave stick 329 having a plurality of output nodes 331, 333, 335, 337 and 339. A compensation resistor 341 is connected between the compensation node 311 and the output node 331. Similarly, compensation resistors 343, 345, 347 and 349 are connected between the compensation nodes 313, 315, 317 and 319 and the corresponding output nodes 333, 335, 337 and 337, respectively.

A bias voltage source 351 is connected across the compensation resistor 341. An end resistor 353 and an end voltage source 355 are connected in series between the output node 331 and ground. A master current source 357 is connected to the compensation node 319 and a slave current source 359 is connected to the output node 339.

An input of a buffer amplifier 361 is connected to the output node 331. Similarly, inputs of buffer amplifiers 363, 365, 376 and 369 are connected to the output nodes 333, 335, 337 and 339, respectively.

A plurality 371 of resistors are connected in series between an output of the amplifier 361 and an output of the amplifier 363. Similarly, pluralities 373, 375 and 377 of resistors are connected in series between outputs of the amplifiers 363 and 365, 365 and 367, and 367 and 369, respectively.

The master resistors 301, 303, 305 and 307 have values of 152 ohms, 154 ohms, 156 ohms and 158 ohms, respectively. Each of the slave resistors 321, 323, 325 and 327 has a value of 64 ohms, as does the end resistor 353. Each of the compensation resistors 341, 343, 345, 347 and 349 has a value of 4,000 ohms The bias voltage source 351 provides a bias voltage of 1.1 volts, the end voltage source 355 provides a voltage of 1.31 volts, the master through the master stick 309, and the slave current source 359 causes a current of 5 milliamps to flow through the slave stick 329.

The plurality 371 of resistors comprises 32 one-ohm resistors. Similarly, each of the pluralities 373, 375 and 377 of resistors comprises 32 one-ohm resistors.

In operation, each amplifier 361, 363, 365, 367 and 369 receives a reference voltage from the output node to which it is connected. Any load current drawn by the amplifiers from the output nodes is compensated by the compensation resistors and the master stick in a manner which has already been described. The amplifiers serve to isolate the slave stick from the pluralities of resistors. Output voltages provided by the amplifiers are divided by the pluralities of resistors such that a final output voltage is provided at each end of each of these resistors. Thus, a total of 129 final output voltages are provided. These voltages are used, for example, as reference voltages in an analog-to-digital converter (not shown).

From the foregoing, it will be appreciated that the reference voltage source provides a large number of reference voltages with equal step size between voltages despite loads connected to the reference voltage source. The circuitry, which is very tolerant to component inaccuracies, is simple, easily fabricated with various technologies and can also be easily made to be temperature compensated.

Although a specific embodiment of the invention has been described and illustrated, the invention is not to be limited to the specific forms or arrangements of parts so described and illustrated, and various modifications and changes can be made without departing from the scope and spirit of the invention. Within the scope of the appended claims, therefore, the invention may be practiced otherwise than as specifically described and illustrated.

I claim:

1. A reference voltage source comprising:

a plurality of slave resistors connected in series to define a slave stick having a plurality of output nodes;

a plurality of master resistors connected in series to define a master stick having a plurality of compensation nodes, each compensation node corresponding with one of the output nodes, the master stick having two ends, the first end being the first compensation node and the second end being the last compensation node;

a plurality of compensation resistors, one such resistor associated with each compensation node, each such resistor connected between its associated compensation node and the corresponding output node;

means for causing a slave electric current to flow through the slave resistors and generate a reference voltage at each output node; and means for causing a master electric current to flow through the master resistors and generate at each compensation node a compensation voltage that differs from the reference voltage at the corresponding output node by a magnitude sufficient to cause a compensation current to flow through the associated compensation resistor into the corresponding output node and offset a load current drawn from the output node.

2. A reference voltage source as recited in claim 1 wherein the number of output nodes is equal to the number of compensation nodes; and the reference voltage source is configured such that the voltage across all the master resistors on the master stick is approximately equal to the voltage across all the slave resistors on the slave stick.

3. A reference voltage source as recited in claim 1 wherein the output node corresponding to the first compensation node is connected to ground; and the reference voltage source comprises a bias voltage source connected between the first compensation node and ground.

4. A reference voltage source as recited in claim 1 wherein:

each of the slave resistors is approximately the same in physical construction and in value as each of the other slave resistors;

each of the master resistors is approximately the same in physical construction and in value as each of the other master resistors;

each of the compensation resistors is approximately the same in physical construction and in value as each of the other compensation resistors; and the reference voltage source is configured such that the voltage across all the master resistors on the master stick is approximately equal to the voltage across all the slave resistors on the slave stick.

5. A reference voltage source as recited in claim 3 wherein:

each of the slave resistors is approximately the same in physical construction and in value as each of the other slave resistors;

each of the master resistors is approximately the same in physical construction and in value as each of the other master resistors;

each of the compensation resistors is approximately the same in physical construction and in value as each of the other compensation resistors; and the bias voltage source comprises:

means for generating a reference current approximately equal in magnitude and direction to the load current;

an operational amplifier having an inverting input connected to receive the reference current from the current generating means, a noninverting input connected to ground and an output connected to the first compensation node; and a resistor, approximately the same in physical construction and in value as the compensation resistor, connected between the inverting input and the output of the operational amplifier.

6. A reference voltage source as recited in claim 1 further comprising:

an end voltage source connected between the output node corresponding to the first compensation node and ground; and a bias voltage source connected between the first compensation node and the corresponding output node such that the range of the voltages on the output nodes can be translated by changing the end voltage source.

7. A reference voltage source as recited in claim 6 wherein:

each of the slave resistors is approximately the same in physical construction and in value as each of the other slave resistors;

each of the master resistors is approximately the same in physical construction and in value as each of the other master resistors;

each of the compensation resistors is approximately the same in physical construction and in value as each of the other compensation resistors;

the reference voltage source is configured such that the voltage across all the master resistors on the master stick is approximately equal to the voltage across all the slave resistors on the slave stick; and the bias voltage source comprises:

means for generating a reference current approximately equal in magnitude and direction to the load current;

an operational amplifier having an inverting input connected to receive the reference current from the current generating means, a noninverting input connected to ground and an output connected to the first compensation node; and a resistor, approximately the same in physical construction and in value as the compensation resistor, connected between the inverting input and the output of the operational amplifier.

8. A reference voltage source as recited in claim 2 wherein:

each of the slave resistors is approximately the same in physical construction and in value as each of the other slave resistors;

each of the master resistors is approximately the same in physical construction and in value as each of the other master resistors; and each of the compensation resistors is approximately the same in physical construction and in value as each of the other compensation resistors.

9. A reference voltage source as recited in claim 8 wherein:

the means for causing the master current to flow from the first compensation node to the last compensation node comprises a current source connected to the last compensation node; and the values of the master resistors decrement from a normal master resistor value, starting from the master resistor connected to the last compensation node to the master resistor connected to the first compensation node, by a constant step size of (normal master resistor value * compensation current/master current) so that the voltage across each pair of adjacent compensation nodes is approximately the same as the voltage across each of the other pairs of adjacent compensation nodes.

10. A reference voltage source comprising:

a plurality of master resistors connected in series to define a master stick with two ends, the master stick having:

a first compensation node at the first end of the master stick, a last compensation node at the second end of the master stick, and one or more intermediate compensation nodes therebetween;

a plurality of slave resistors connected in series to define a slave stick having:

a first primary output node corresponding with the first compensation node, a last primary output node corresponding with the last compensation node, one or more intermediate output nodes therebetween, each corresponding with a different one of the intermediate compensation node, and between each adjacent pair of primary output nodes, one or more secondary output nodes;

a plurality of compensation resistors, one such resistor associated with each compensation node, each such resistor connected between its associated compensation node and the corresponding primary output node;

means for causing a slave electric current to flow through the slave resistors and generate a reference voltage at each primary output node and each secondary output node; and means for causing a master electric current to flow through the master resistors and generate at each compensation node a compensation voltage that differs from the reference voltage at the corresponding primary output node by a magnitude sufficient to cause a compensation current to flow through the associated compensation resistor into the corresponding primary output node such that the sum of the currents flowing through all the compensation resistors is approximately equal to the sum of the load currents drawn from all the output nodes.

11. A reference voltage source as recited in claim 10 wherein the reference voltage source is configured such that the voltage across all the master resistors on the master stick is approximately equal to the voltage across all the slave resistors on the slave stick.

12. A reference voltage source as recited in claim 11 wherein:

the number of secondary output nodes between each adjacent pair of primary output nodes is the same as the number of secondary output nodes between each other adjacent pair of primary output nodes; and the reference voltage source is configured such that:

the current flowing into the first primary output node through the compensation resistor connected thereto is approximately equal to any load current drawn from the first primary output node plus one-half the sum of any load currents drawn from all the secondary output nodes between the first primary output node and the adjacent primary output node;

the current flowing into the last primary output node through the compensation resistor connected thereto is approximately equal to any load current drawn from the last primary output node plus one-half the sum of any load currents drawn from all the secondary output nodes between the last primary output node and the adjacent primary output node; and the current flowing into each intermediate primary output node through the compensation resistor connected thereto is approximately equal to any load current drawn from the intermediate primary output node plus the sum of any load currents drawn from all the secondary output nodes between the intermediate primary output node and the adjacent primary output node on either side of the intermediate primary output node.

13. A reference voltage source as recited in claim 12 wherein:

each of the slave resistors is approximately the same in physical construction and in value as each of the other slave resistors;

each of the master resistors is approximately the same in physical construction and in value as each of the other master resistors; and each of the compensation resistors is approximately the same in physical construction and in value as each of the other compensation resistors.

* * * * *